US008522852B2

(12) United States Patent
Yu et al.

(10) Patent No.: US 8,522,852 B2
(45) **Date of Patent: *Sep. 3, 2013**

(54) SUSPENSION SYSTEM FOR A CORDLESS WINDOW COVERING

(75) Inventors: Fu-Lai Yu, Taipei Hsieh (TW); Chin-Tien Huang, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/135,023

(22) Filed: Jun. 23, 2011

(65) Prior Publication Data

US 2011/0259535 A1 Oct. 27, 2011

Related U.S. Application Data

(63) Continuation of application No. 11/591,718, filed on Nov. 2, 2006, now Pat. No. 7,975,748.

(51) Int. Cl.
*E06B 3/322* (2006.01)

(52) U.S. Cl.
USPC ..... 160/84.05; 160/170

(58) Field of Classification Search
USPC ..... 160/170, 171, 84.04, 84.05, 168.1 R
See application file for complete search history.

(56) References Cited

U.S. PATENT DOCUMENTS 2,276,716 A 3/1942 Cardona
4,372,432 A 2/1983 Waine et al.
4,433,765 A 2/1984 Rude et al.
4,623,012 A 11/1986 Rude et al.
4,697,630 A 10/1987 Rude et al.
5,482,100 A 1/1996 Kuhar
5,531,257 A 7/1996 Kuhar
5,793,174 A 8/1998 Kovach
5,964,427 A 10/1999 Aiston
5,990,646 A 11/1999 Kovach et al.
6,012,506 A 1/2000 Wang et al.
6,024,154 A 2/2000 Wang et al.
6,029,734 A 2/2000 Wang et al.
6,056,036 A 5/2000 Todd et al.
6,057,658 A 5/2000 Kovach et al.
6,079,471 A 6/2000 Kuhar
6,181,089 B1 1/2001 Kovach et al.
6,234,236 B1 5/2001 Kuhar
6,259,218 B1 7/2001 Kovach et al.
6,289,965 B1 9/2001 Ruggles
6,330,899 B1 12/2001 Ciuca et al.
6,369,530 B2 4/2002 Kovach et al.
6,474,394 B2 11/2002 Kuhar
6,508,293 B1 * 1/2003 Huang ..... 160/170
6,571,853 B1 6/2003 Ciuca et al.
6,575,223 B1 6/2003 Chung et al.
6,601,635 B2 8/2003 Ciuca et al.
6,644,372 B2 11/2003 Judkins
6,644,373 B2 11/2003 Palmer
6,644,374 B2 11/2003 Nien
6,644,375 B2 11/2003 Palmer
6,662,850 B2 12/2003 Chung et al.

(Continued)

*Primary Examiner* — David Purol
(74) *Attorney, Agent, or Firm* — Olson & Cepuritis, Ltd.

(57) ABSTRACT

A suspension system for a window covering that eliminates the use of pull cords is provided. The suspension system includes a control module having a winding drum and a spring disposed about an axle. A friction member or reaction member is also provided to offset difference in the force exerted by the spring on a suspension cord versus the weight of the window covering member.

19 Claims, 4 Drawing Sheets

(56) References Cited

U.S. PATENT DOCUMENTS

| | | | | |
|---|---|---|---|---|
| 6,684,930 | B2 | 2/2004 | Palmer et al. | |
| 6,691,760 | B1 | 2/2004 | Randall, Jr. et al. | |
| 6,725,897 | B2 | 4/2004 | Palmer | |
| 6,823,925 | B2 | 11/2004 | Miliello et al. | |
| 7,975,748 | B2 * | 7/2011 | Yu et al. | 160/84.05 |
| 2002/0157796 | A1 | 10/2002 | Judkins | |
| 2003/0178155 | A1 * | 9/2003 | Fraczek | 160/170 |
| 2004/0007333 | A1 | 1/2004 | Militello et al. | |
| 2004/0094274 | A1 | 5/2004 | Judkins | |
| 2004/0177933 | A1 | 9/2004 | Hillman et al. | |

* cited by examiner

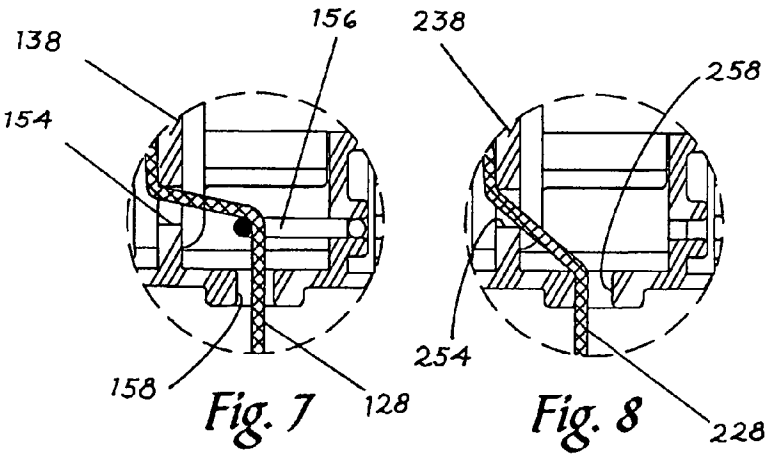
Fig. 8
Fig. 7
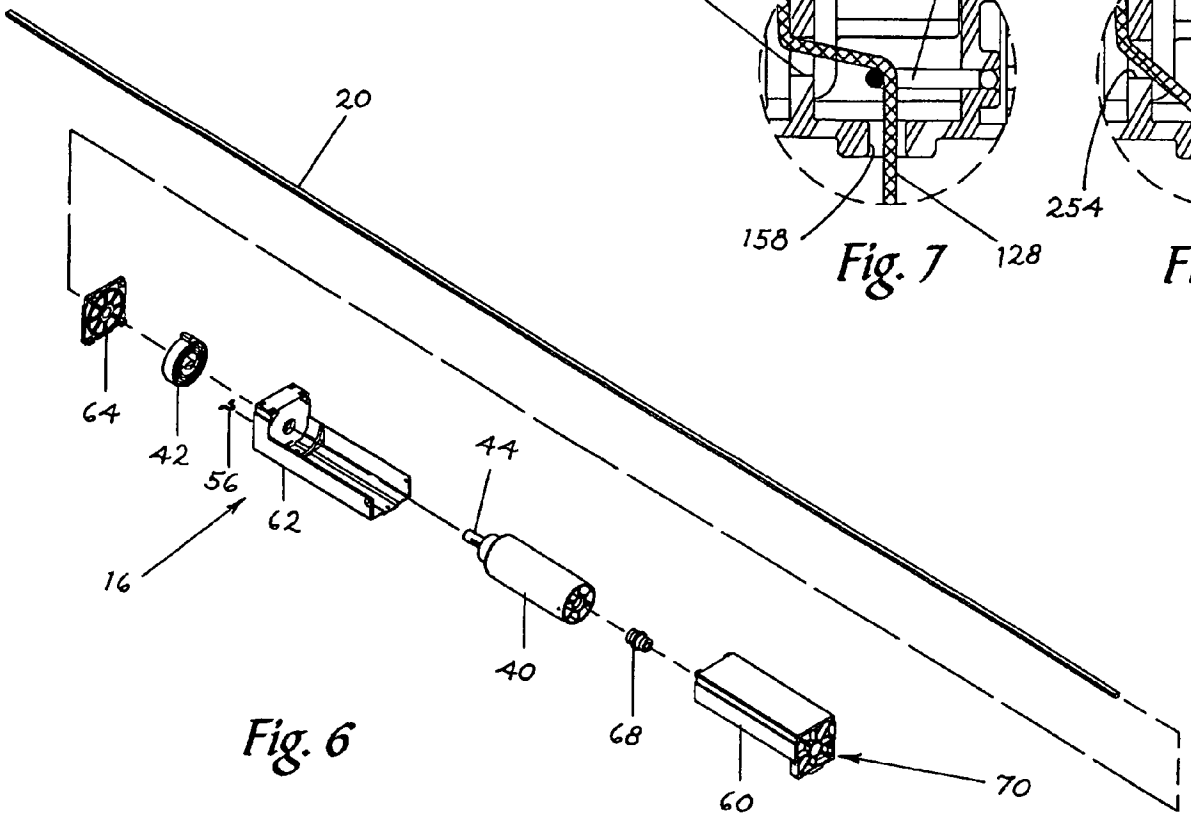
Fig. 6

SUSPENSION SYSTEM FOR A CORDLESS WINDOW COVERING

CROSS-REFERENCE TO RELATED APPLICATION

This application is a continuation of application Ser. No. 11/591,718 filed Nov. 2, 2006 now U.S. Pat. No. 7,975,748, the disclosure of which is incorporated by reference.

TECHNICAL FIELD OF THE INVENTION

This invention relates to suspension system for a window covering. The suspension system provides a mechanism for control of the window covering without use of a pull cord.

BACKGROUND OF THE INVENTION

Window coverings, such as honeycomb window shades, Venetian blinds, and Roman shades typically have a head rail and a window cover material, such as pleated fabric, a plurality of slats, or blind members, which are controlled by cords, whereby a pull cord coupled to the slats, blind members, or fabric can be adjusted to raise or open the window covering. The pull cord extends from a headrail and is manipulated by a user to adjust the position of suspension cords and to thereby adjust the position of the window cover material. One shortcoming of such pull cords is that they require peripheral members that distract from the window cover material and can lessen the aesthetic appearance of the window covering. In addition, pull cords also present a potentially dangerous situation in that they are of relatively long lengths and may be mishandled by certain persons, especially children, such that accidental choking or hanging may occur.

There have been various developments in window coverings that do not utilize a lifting cord with a cord lock. One such patent is U.S. Pat. No. 2,420,301, issued May 13, 1947 to Cusumano for "Venetian Blind" which utilizes a cone-shaped member with grooves and a coil spring. This window covering design includes a counterbalance to enable positioning of the blind slats as desired without a lock. Another attempt includes U.S. Pat. No. 2,324,536 issued to Pratt and titled "Closure Structure" and utilizes tapes and coil springs to raise and lower a blind in which the bottom bar and the slats ride in tracks as they move upwardly and downwardly.

One issue that has been presented in other so-called cordless window coverings is that as a window covering is raised, increasing amounts of the window cover material are gathered and supported on the bottom rail, thereby increasing the weight suspended by the suspension cord. One patent directed to addressing this problem is U.S. Pat. No. 5,133,399, issued to Hiller et al. and titled "Apparatus by Which Horizontal and Vertical Blinds, Pleated Shades, Drapes and the Like May Be Balanced for No Load Operation." In this device, a variable, upwardly directed force is applied to the cord structure with the force being substantially equivalent at all times to the combined weights of the lower rail and the blind members supported on the lower rail when the lower rail is above its lowermost operative position. The apparatus for applying the force includes a conical member coupled to a constant force spring or a variable force leaf spring. Other patents include U.S. Pat. No. 5,482,100, issued to Kuhar and titled "Cordless, Balanced Venetian Blind or Shade with Consistent Variable Force Spring Motor."

In one version, a variable force spring is wound on drums whereby spring force imparted to a coiled spring is transferred from one drum to another. With these variable force spring motors, the force exerted is at its greatest when the blind or shade is fully raised such that the cords are supporting most or all of the weight for the bottom rail and the window cover material. The spring force is at its lowest point when the window covering is fully lowered such that only the bottom rail is supported by the suspension cord. In another embodiment, a constant force spring is utilized with a friction imparting device to accommodate the variable weight of the window covering between the raised and lowered positions.

One shortcoming of the previous attempts, however, is the complexity of the designs in that a substantial number of interconnected parts are required. The present invention provides a cordless window covering and does so in a more efficient manner.

SUMMARY OF THE INVENTION

The present invention is directed to a window covering that does not require the use of pull cords. In a preferred embodiment, the present invention includes a window covering suspension system that includes a head rail, at least one suspension cord, a control module and a friction member or reaction member. The suspension system can be combined with a window cover member that includes a window cover material and a weighted element, such as a bottom rail, to form the window covering.

The head rail preferably includes a transverse channel. A rotary axle is disposed within the channel and defines a longitudinal axis. At least one control module is positioned in the channel and the rotary axle extends through the control module. Preferably, more than one control module is positioned about the axle so that they operate together to evenly open and close the window covering.

The control module includes a support structure, such as a housing, into which a rotary winding drum and a spring are positioned and supported by the support structure. The spring is preferably a constant force flat spiral spring. The winding drum and spring are operatively connected to one another such that the spring exerts a rotational force on the winding drum. Preferably, the winding drum and spring are connected by a rotary spindle, and each of the winding drum, rotary spindle, and spring are positioned about the rotary axle. These components of the control module may be coaxial with one another. A friction member or reaction member is also provided for reasons discussed in further detail below.

A first end of the suspension cord is connected to the winding drum such that as the winding drum is rotated by the rotational force provided by the spring, the suspension cord is wound thereon. As discussed, the spring is preferably a constant force spring that provides a substantially constant amount of torque throughout the range of extension for the spring. Suitable constant force springs are known in the art. With such springs, the force exerted by the spring to resist uncoiling is constant since the change in the radius of curvature is constant.

A second end of the suspension cord is connected to weighted element, e.g., a bottom rail of the window cover member, such that as the suspension cord is wound on the winding drum, the bottom rail is raised and window cover material is gathered on the bottom rail. The suspension cord travels a path that engages the friction member or reaction member, such as a hook that may take the form of a standard hook, and eyelet, horseshoe-shaped member, u-shaped member, or other piece through which the suspension cord may pass. The support structure may also be configured to form the friction member or reaction member by offsetting surfaces formed within the support structure such that the suspension cord is caused to travel a path including a plurality of turns, and preferably at least three turns, thereby increasing the force required to overcome the static friction force on the cord. Similarly, by including a plurality of turns, the reaction force on the cord by the reaction member is increased. The suspension system may also include a combination of such friction members or reaction members.

In use, the spring is configured to exert a rotational force on the winding drum. The rotational force is translated by the winding drum to an upward force on a portion of the suspension cord as the window covering is moved between a lowered position and a raised position. For example, as the cord is wound on the winding drum, the tangential force of the winding drum is the upward force on the cord. At the same time, the suspension cord supports the weight of the window cover material and bottom rail. As discussed, the total weight supported by the cord increases as the window covering is raised from a lowered position to a raised position due to the increasing amount of window cover material supported by the bottom rail. The amount of cord also contributes to the overall weight, but only to a relatively small degree. An additional force opposite the gravitational force may come from the window cover material itself in that the material, such as found in a honeycomb or cellular shade, may possess an inherent spring force. For example, a honeycomb or cellular window cover material, when stretched, will tend to retract as a result of memory in the material.

The friction member provides a static friction force to the cord and is configured to provide sufficient static friction such that the difference between the weight of the window cover member and cord versus the sum of the window cover material spring force and the spring upward force are offset, thereby maintaining a desired position for the window covering. In other words, when the window covering is stationary or not being adjusted, the static friction force offsets the net result of the other upward and downward forces on the suspension cord such that the window cover member is not unintentionally raised or lowered. This friction member engages the cord, and is preferably positioned downstream of the winding drum. In other words, the friction member is positioned to engage a portion of the cord that is not wound on the winding drum.

The amount of friction can be adjusted depending on the weight of the window cover member and the cord texture and thickness by configuring the friction member, such as the hook member, to cause the suspension member to travel a path that includes a plurality of turns. The distances between turns, the angles of the turns, and the amount of contact between the friction member and the cord can all be adjusted to provide the desired amount of static friction suitable for a particular application. A higher static friction allows the same control module to be used over a greater range of window covering lengths.

The hook may also be a reaction member designed to prevent undesired movement of the bottom rail and ensure a stationary position (e.g., no movement between the cord and the hook). A reaction force exerted by the hook on the cord, or other offset surfaces, contributes to counteract the force of the spring to keep stationary the cord when the bottom rail is positioned at the desired height.

As discussed, however, the winding drum and spring in the control module are preferably in a coaxial relationship with one another and are engaged with the axle which is guided through the winding drum and spring. In this manner, multiple similarly configured control modules may be utilized to accommodate different weight window cover members and different size window coverings. Such modularity provides substantial advantages over the prior art.

A clutch mechanism may also be included in the suspension system to provide even greater flexibility in design. Clutch mechanisms, such as utilized in roller shades are generally known, and are designed to engage a rotating axle to releasably lock the axle. With the present invention, a clutch mechanism may be employed along with the control module.

BRIEF DESCRIPTION OF THE DRAWINGS

In the drawings,

FIG. 6 is an exploded view of the control module of FIG. 4 and the axle;

FIG. 7 is an enlarged view of an alternate preferred embodiment of a friction member; and FIG. 8 is an enlarged view of another alternate preferred embodiment of a friction member.

DESCRIPTION OF THE PREFERRED EMBODIMENTS OF THE INVENTION

Figure 1:
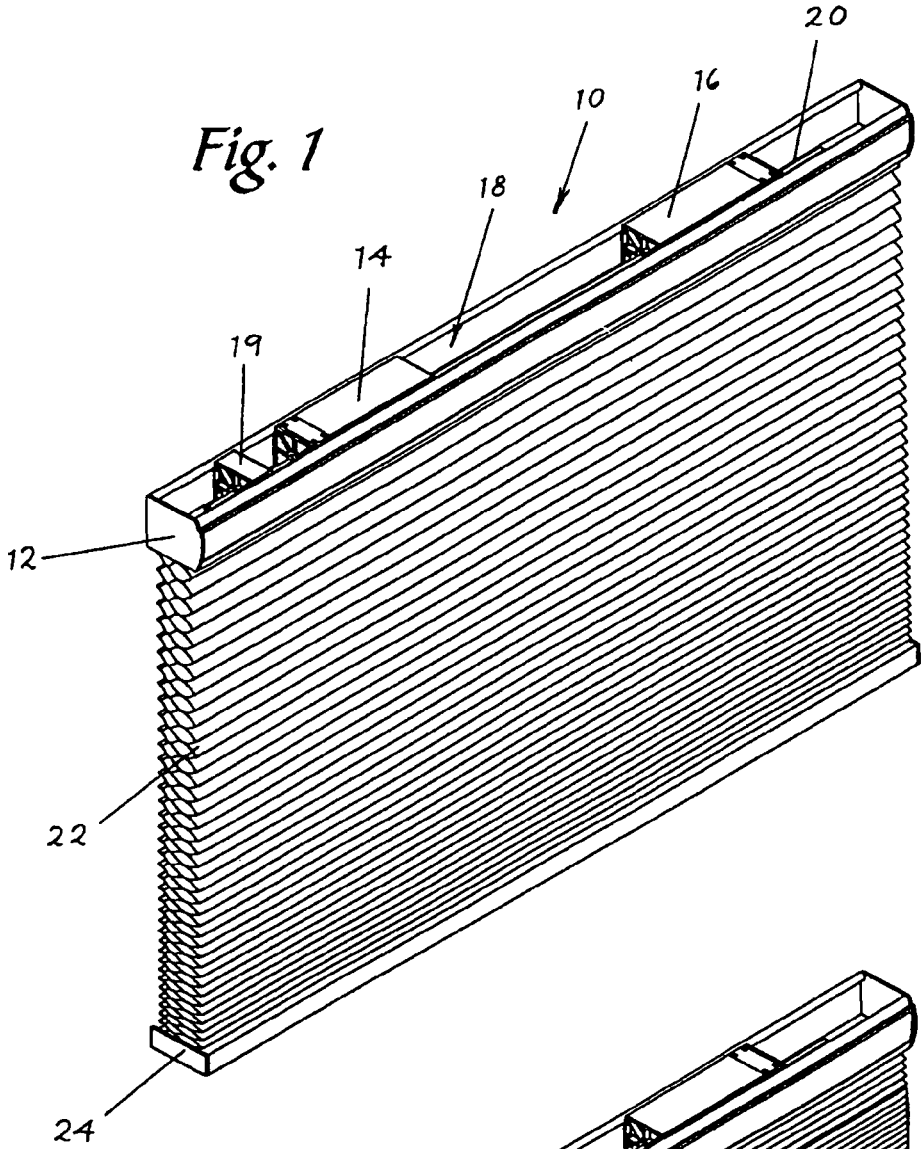
FIG. 1 is a perspective view of a preferred embodiment of the present invention with a window covering in a lowered position.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Referring to FIG. 1, a preferred embodiment of the present invention is shown. Window covering 10 includes a head rail 12, a pair of control modules 14, 16 positioned within a channel 18 of the head rail 12 about axle 20. A window cover member is also provided comprising window cover material 22 and weighted element, such as bottom rail 24. As shown, the window covering 10 is in a lowered position such that the window cover material 22 is extended to cover a window space. In this particular embodiment, the window cover material 22 is shown as a double cell cellular material, however, other materials may also be used including honeycomb materials, Venetian blinds, Roman shades, Roman style shades, or the like. Also shown in this embodiment in engagement with the axle 20 is a clutch mechanism 19. Any clutch mechanism as is known in the art may be utilized. For example, clutch mechanism 19 may be configured such that it locks the axle when engaged. By pulling down on bottom rail 24 slightly, the clutch member is disengaged from the axle to permit rotation of the axle 20. When the window covering is in the desired position, the bottom rail 24 is again pulled down slightly to engage the clutch mechanism 19.

Figure 2:
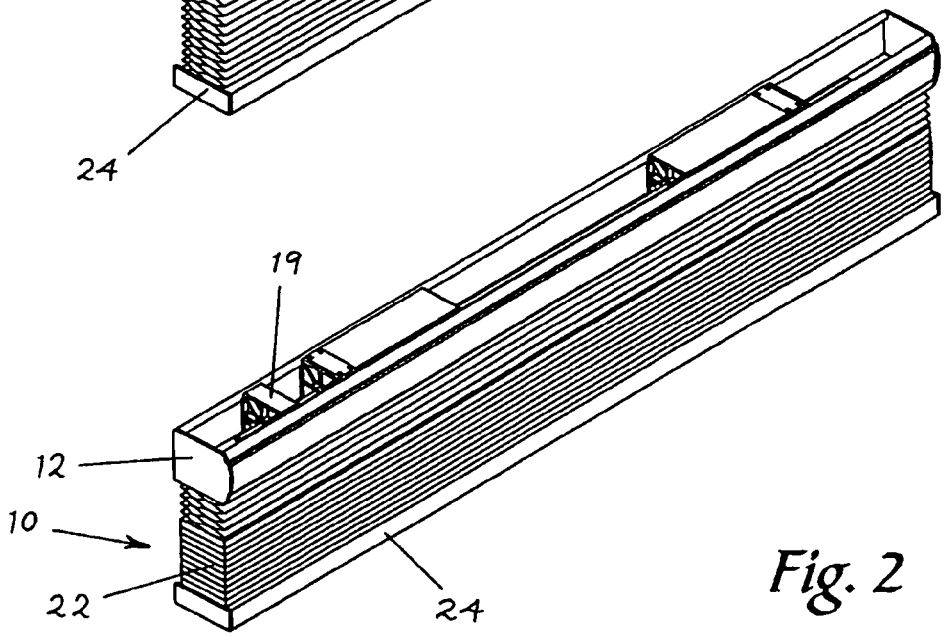
FIG. 2 is a perspective view of the embodiment of FIG. 1 with the window covering in a partially raised position.
Figure 3:
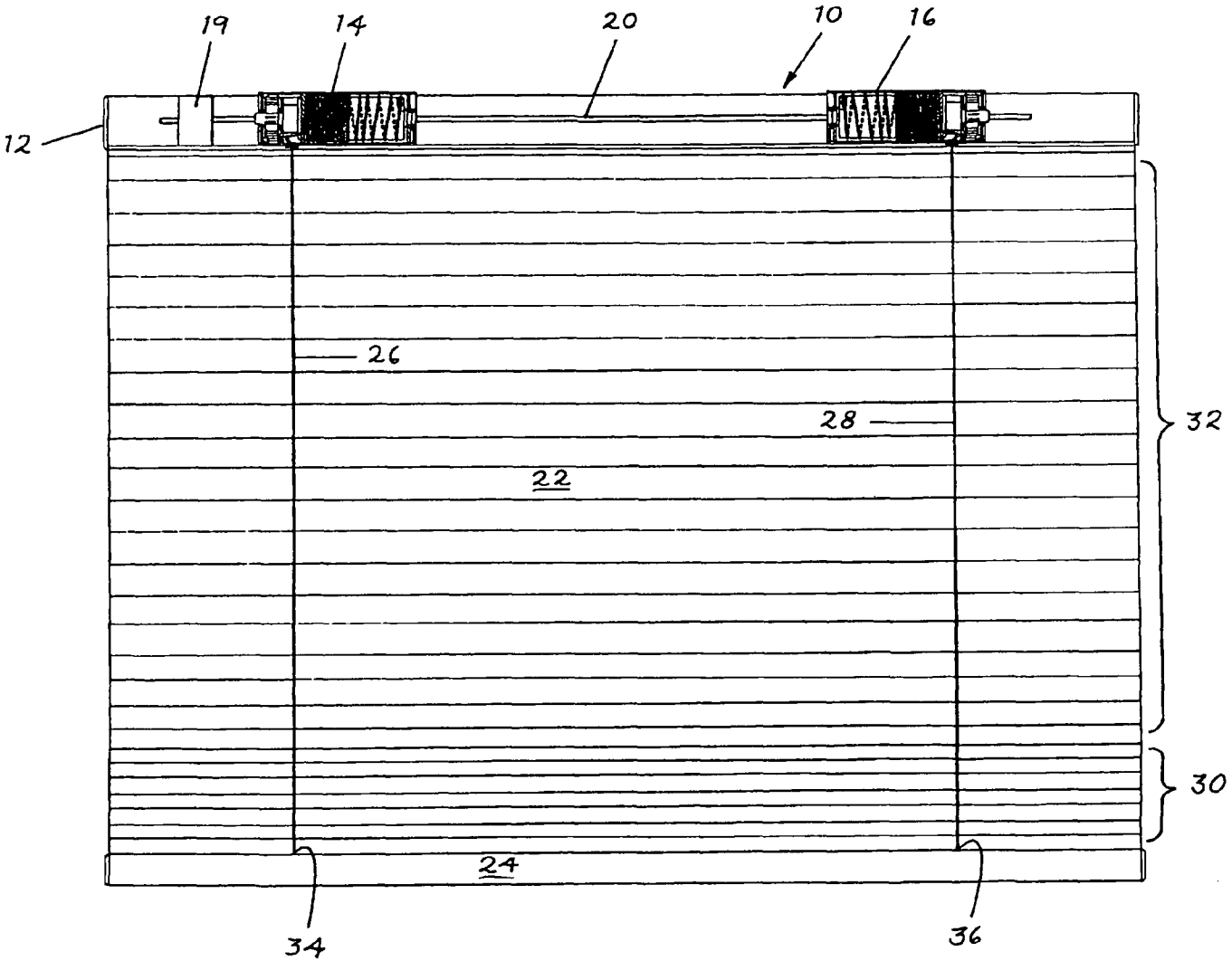
FIG. 3 is a front view of a preferred embodiment of the present invention in a partially raised position with the head rail and housing of the control module cut away and suspension cords shown in phantom.

Shown in FIG. 2 is the window covering 10 of FIG. 1 in a partially raised position. As the window covering 10 is raised, window cover material 22 is gathered and supported by bottom rail 24. This is more clearly shown in FIG. 3. Suspension cords 26, 28 extend from control modules 14, 16, respectively, pass through window cover material 22, and are connected with bottom rail 24. In this preferred embodiment, the suspension cords 26, 28 are connected directly to bottom rail 24, however, other methods of operatively connecting the bottom rail to the suspension cords may also be utilized. For example, fastener modules may be used to enable the bottom rail to be easily replaced. In certain applications, a panel of material may be combined with a bottom rail such that the suspension cords are connected to the bottom rail by way of attachment to a connected panel of material. While the weighted element has been described thus far as a bottom rail, it is not limited to a straight elongated structure; instead, any weighted member can be utilized. Also, while two control modules 14, 16 are shown engaged with axle 20, it should be understood that any number of control modules can be used.

As the window covering 10 is moved from a lowered position to a raised position, the suspension cords 26, 28 are wound within control modules 14, 16 in a manner described in greater detail below. As the bottom rail 24 is brought closer to head rail 12, window cover material 22 is gathered and supported by the bottom rail 24. As shown, a gathered portion 30 of window cover material 22 is resting on the bottom rail, such that the weight of gathered portion 30 plus the bottom rail 24 are supported by the suspension cords 26, 28. The ungathered portion 32 of the window cover material 22 is suspended from head rail 12 and is not supported by the suspension cords 26, 28. As should be readily understood, the weight, supported by the suspension cords 26, 28 increases as the window covering 10 is moved to a raised position. In other words, the weight on the ends 34 and 36 of suspension cords 26, 28 increases as more window cover material 22 is gathered and supported by the bottom rail 24. Although not shown, in the context of a Venetian blind, the number of slats that would be supported by the suspension cords, as opposed to ladder cords, would increase as the Venetian blind is raised.

In this particular embodiment, two control modules 14, 16 are mounted about axle 20. As discussed, the number of modules in a particular window covering can vary as needed. Due to the modular nature of the control modules and the common axle, stock quantities of the control modules can be utilized rather than require adjustment of individual control modules that increases manufacturing costs and complexity. Also, given the nature of window coverings as often being customized for a particular window, modular control modules provide greater flexibility in manufacturing. The use of a common axle to connect the plurality of control modules also provides for a simple and reliable means for synchronization and balancing of the control modules to promote even lifting of the window covering, unlike the prior art.

Figure 4:
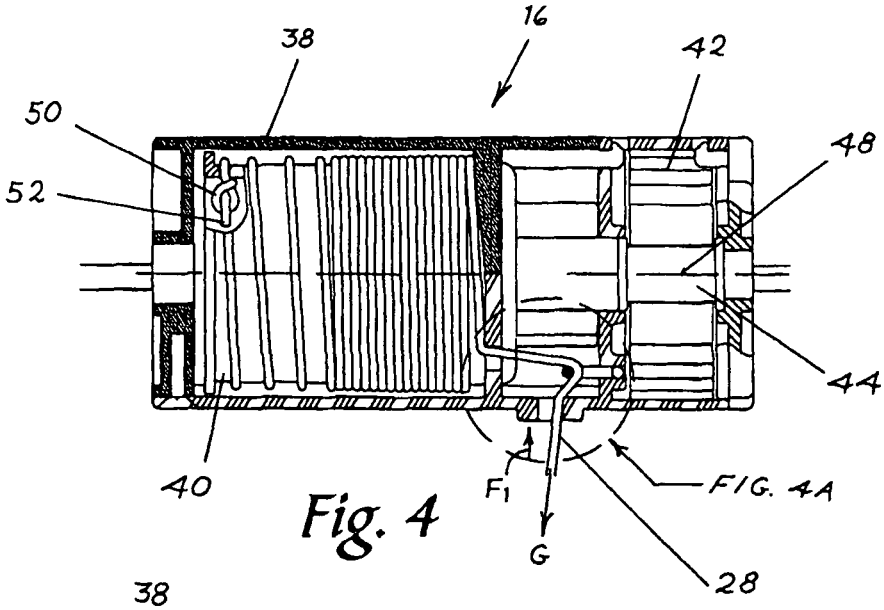
FIG. 4 is a side elevated view of a preferred control module of the present invention with portions shown in cross section.
Figure 5:
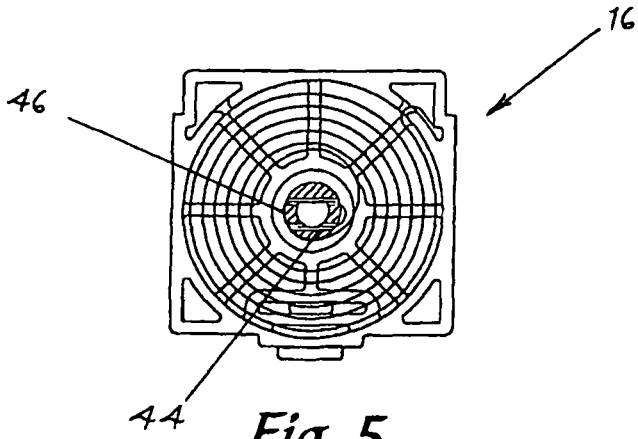
FIG. 5 is an end view of the control module of FIG. 4.

Greater detail on the control modules is described with FIGS. 4-6. Referring to FIG. 4, control module 16 is shown. Control module 16 includes a support structure, such as housing 38. Positioned within housing 38 are a winding drum 40 and a spring 42 (shown in cross section). The winding drum 40 and spring 42 are operatively connected to one another such that the spring 42 exerts a rotational force, i.e., torque, on the winding drum 40. In this embodiment, the winding drum 40 and spring 42 are connected by a rotary spindle 44 that is integrally formed with the winding drum 40. Referring to FIG. 5, the spring 42 is secured at an end 46 to spindle 44. Preferably, spring 42 is a constant force spring that provides a constant amount of force or torque throughout the range of extension of the spring. Each of the winding drum 40, rotary spindle 44 and spring 42 are positioned about the rotary axle 20, which also defines a longitudinal axis 48. It is preferred that winding drum 40, rotary spindle 44 and spring 42 are coaxial with one another. The axle 20 inserts through the drum 40 and spindle 44 as the control module 16 is mounted on the axle 20. This simple assembly permits easy and flexible mount of many control modules for wider window covering requiring more suspension cords.

Figure 4A:
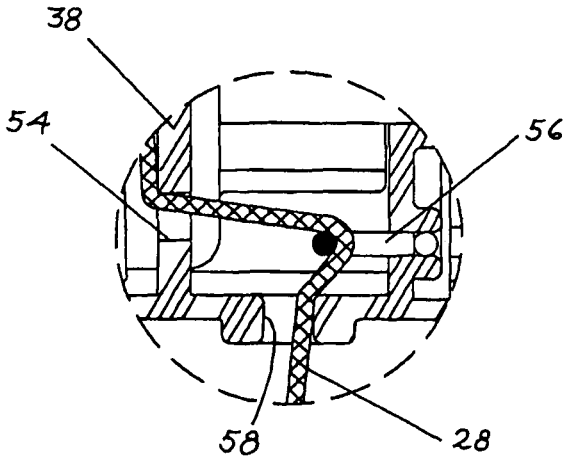
FIG. 4A is an enlarged view of the friction member of the control module of FIG. 4.

Referring again to FIG. 4, suspension cord 28 is secured at a first end 50 to a post 52 formed on winding drum 40. When window covering 10 (FIG. 3) is raised, the suspension cord 28 is wound on winding drum 40 rotated by the torque from spring 42. Referring to FIG. 4A, the suspension cord 28, in this embodiment, is passed through hole 54 formed in housing 38. Suspension cord then travels a path though hook 56, and then exits housing 38 through hole 58. As such, the suspension cord 28 travels a path including three turns between the winding drum 40 and the window cover member including window cover material 22 and bottom rail 24. The engagement with the housing 38 as the suspension cord 28 passes though holes 54 and 58, as well as the engagement with the hook 56 generate a static friction force on the suspension cord 28 that resists movement when the window covering 10 is stationary, i.e., not being adjusted. The housing 38 and the hook 56 also provide a reaction force on the suspension cord 28.

Referring again to FIG. 4, the spring 42 exerts a rotational force on winding drum 40 that, because the first end 50 of the suspension cord 28 is secured to winding drum 40, is translated to a force ($F_1$) on the suspension cord 28. Yet another force that is applied to suspension cord 28 when the window covering 10 is stationary is the weight (G) of the window cover material 22 the portion of the cord which is unwound, and the bottom rail 24. The amount of cord unwound from the winding drum 40 contributes to the overall weight to a relatively small degree while the bottom rail 24 preferably provides most of the weight (G). Also, as discussed, in some window coverings, the window cover material 22 itself may contribute a force $F_2$ (not shown) to the bottom rail 24 opposite to the force of gravity. This force $F_2$ is significantly smaller than the force $F_1$. In other words, the downward weight exerted on the suspension cord 28 is lighter for vertically lower positions of the bottom rail 24. In these configurations, the sustaining force exerted by the spring 42 may exceed the downward weight and adversely cause an upwardly biased displacement of the bottom rail 24.

In order to prevent the foregoing unintended movement, the friction member, which in this embodiment comprises the engagement locations with the housing 38 as the suspension cord passes through holes 54 and 58 and the hook 56, is put in contact with the cord to create the static friction force $F_{static}$ that suitably balances the difference between the opposing forces applied to the cord 28. The forces that tend to move the window cover 10 to a raised position applied to the suspension cord 28 include the force $F_1$ from the spring 42 and the spring force of the window cover material 22. Counterbalancing these raising forces are the downward forces G caused by the weight of the window cover material 22 and the bottom rail 24, and to a minor degree the unwound portion of the suspension cord 28. The total weight on the suspension cord 28 increases as the window covering 10 is raised from a lowered position to a raised position due to increasing amount of the window cover material 22 supported by the bottom rail 24.

In order to prevent unintended movement of the window covering 10, the friction member is positioned downstream of the winding drum, which in this embodiment comprises the engagement with the housing 38 as the suspension cord 28 passes though holes 54 and 58 and the engagement with the hook 56, creates a static friction force $F_{static}$ that is greater than or equal to the difference between the total gravitational force G and the sum of Force $F_1$ and $F_2$ regardless of the position of the window cover 10. In other words:

$F_{static}G-(F_1+F_2)$, where:

G is the weight of the window cover material, bottom rail, and unwound portion of the cord;

$F_1$ is the linear force exerted by the spring on the suspension cord;

$F_2$ is the spring force of the window cover material on bottom rail; and $F_{static}$ is the static friction force of the friction member.

The suitable amount of frictional force can be determined depending on factors such as the weight of the window cover member and the cord texture and thickness, bottom rail weight, and spring force of the window cover material. By adjusting one or more of these factors, a sufficient amount of static friction force for the suspension cord can be included in the present invention.

In order to raise window covering 10, a user exerts a force on the bottom rail opposite the force of gravity such that the static friction force $F_{static}$ is overcome. Sufficient force by the user must be exerted such that the difference between the total gravitational force G and the sum of Force $F_1$ and $F_2$ is overcome. Similarly, in order to lower the window covering 10, a user pulls down on the bottom rail so that the static friction force $F_{static}$ is overcome. As should be readily appreciated, this difference is intended to be such that only a moderate amount of force by the user is required.

One of the advantages of the present design is that the static friction is automatically adjusted to meet the needs of the window covering so it remains stationary. As the window covering is opened, the weight G on the cord increases and tends to make the window covering close. However, because the static friction force $F_{static}$ is a function of the tension on the cord as it acts against the friction member, the static friction increases to counteract the increase in weight.

The relevant forces in the present invention may also be viewed from the perspective of reaction forces, and the friction member may be considered as a reaction member. This reaction member exerts a reaction force against the suspension cord to prevent undesired movement of the bottom rail and ensure a stationary position. This counterforce applied to the cord is a reaction force because it counterbalances the force of the suspension cord against the various surfaces. When viewed it in this context, it should be understood that the reaction force is at most equal to the difference between force G and $F_1$ and $F_2$.

Referring to FIG. 6, a brief explanation of the various parts of the control module 16 is provided. The housing 38 includes a cover 60, a base 62 and an end cap 64. Hook 56 is also provided. Winding drum 40 is formed integrally with rotary spindle 44. A separate spindle 68 is also provided which is configured to connect winding drum 40 to end 70 of housing cover 60. Axle 20 is guided through control module 16.

Referring to FIGS. 7 and 8, alternate embodiments of a friction member are shown. In FIG. 7, the suspension member 128 exits though hole 154 formed in housing 138. The suspension cord also engages hook 156 extending over the hole 158. Unlike the previous embodiment, however, the suspension member 128 does not engage hole 158. As such, in this embodiment, the cord travels along a path having two turns. In FIG. 8, no hook member is included. In this embodiment, the suspension cord 228 interacts with the rims of the holes 254 and 258 through which it travels.

The descriptions above have shown the control modules as being located in the head rail. Is some embodiments, the control modules may be located in the bottom rail, or a combination of the head rail and bottom rail. It may also be desired to exclude the head rail and secure the control modules directly to a window frame.

The foregoing descriptions are to be taken as illustrative, but not limiting. Still other variants within the spirit and scope of the present invention will readily present themselves to those skilled in the art.

What is claimed is:

1. A window covering comprising:

a head rail having a longitudinal axis;

a weighted element;

a window cover material connected between the head rail and the weighted element;

a rotary axle placed in the head rail along the longitudinal axis; and a plurality of control modules placed in the head rail and coupled with the rotary axle at spaced-apart positions along the longitudinal axis, wherein each of the control modules includes:

a housing;

a winding drum pivotally assembled in the housing, wherein the winding drum includes a first and a second drum portion adapted to mount with the rotary axle, the first and second drum portions being formed integrally with the winding drum;

a suspension cord having a first and a second end, the first end being connected with the first drum portion, and the second end extending outside the housing and being connected with the weighted element; and a spring connected with the second drum portion, the spring being operable to bias the winding drum and the rotary axle for rotation in a direction to wind the suspension cord around the first drum portion;

wherein the rotary axle passes through the winding drum and the spring.

2. The window covering of claim 1, wherein the spring of at least one of the control modules is a constant force spring.

3. The window covering of claim 1, wherein the second drum portion has a diameter smaller than a diameter of the first drum portion.

4. The window covering of claim 1, wherein the springs in the control modules impart a raising force that counteracts a downward weight force applied at the weighted element to keep the weighted element stationary at any heights relative to the head rail.

5. The window covering of claim 1, wherein the winding drums rotate synchronously via the connection of the rotary axle.

6. The window covering of claim 1, further comprising a friction member that engages with the suspension cord.

7. A control module suitable for assembling with a window covering, the control module comprising:

a rotary axle having a length adapted to receive the placement of multiple cord connections spaced-apart from one another along a width of the window covering;

a housing;

a winding drum pivotally assembled in the housing, wherein the winding drum includes a spindle that is fixedly connected therewith, the winding drum and the spindle being adapted to respectively mount with the rotary axle when the control module is assembled with the window covering;

a suspension cord having a first and a second end, the first end being connected with the winding drum, and the second end extending outside the housing; and a spring mounted around the spindle, the spring being operable to bias the winding drum for rotation in a direction to wind the suspension cord around the winding drum; wherein when the control module is assembled with the rotary axle, the spring, the spindle and the winding drum are disposed coaxial about the rotary axle, the rotary axle respectively passes through the housing, the winding drum and the spindle, and the length of the rotary axle is substantially longer than the housing and the winding drum.

8. The control module of claim 7, wherein the spring is a constant force spring.

9. The control module of claim 7, wherein the spindle has a diameter smaller than a diameter of the winding drum.

10. The control module of claim 7, wherein the housing has two opposite side surfaces provided with aligned openings for passage of the rotary axle there-through.

11. The control module of claim 7, wherein the spindle and the winding drum are formed integrally with each other.

12. The control module of claim 7, further comprising a friction member that engages with the suspension cord.

13. The control module of claim 12, wherein the friction member includes a hook.

14. A window covering comprising:

a head rail having a longitudinal axis;

a weighted element;

a window cover material connected between the head rail and the weighted element;

a rotary axle placed in the head rail along the longitudinal axis; and a plurality of control modules placed in the head rail and coupled with the rotary axle at spaced-apart positions along the longitudinal axis, wherein each ofthe control modules includes:

a housing;

a winding drum pivotally assembled in the housing, wherein the winding drum includes a spindle that is fixedly connected therewith, the winding drum and the spindle being respectively mounted with the rotary axle;

a suspension cord having a first and a second end, the first end being connected with the winding drum, and the second end extending outside the housing and being connected with the weighted element; and a spring connected with the spindle, the spring being operable to bias the winding drum and the rotary axle for rotation in a direction to wind the suspension cord around the winding drum;

wherein the rotary axle passes through the winding drum, the spindle and the spring.

15. The window covering of claim 14, wherein the spring of at least one of the control modules is a constant force spring.

16. The window covering of claim 14, wherein the spindle has a diameter smaller than a diameter of the winding drum.

17. The window covering of claim 14, wherein the springs in the control modules impart a raising force that counteracts a downward weight force applied at the weighted element to keep the weighted element stationary at any heights relative to the head rail.

18. The window covering of claim 14, wherein the winding drums of the control modules rotate synchronously via the connection of the rotary axle.

19. The window covering of claim 14, further comprising a friction member that engages with the suspension cord.

* * * * *

UNITED STATES PATENT AND TRADEMARK OFFICE

CERTIFICATE OF CORRECTION

PATENT NO. : 8,522,852 B2
APPLICATION NO. : 13/135023
DATED : September 3, 2013
INVENTOR(S) : Fu-lai Yu and Chin-tien Huang It is certified that error appears in the above-identified patent and that said Letters Patent is hereby corrected as shown below:

IN THE SPECIFICATION:

Column 6, line 13, delete "though" and insert --through--
Column 6, line 19, delete "though" and insert --through--
Column 6, line 67, delete "though" and insert --through--

Column 7, line 48, delete "When viewed it in this context," and insert --When viewed in this context,--
Column 7, line 60, delete "though" and insert --through--

IN THE CLAIMS:

Column 9, line 33 (Claim 14) insert a space between "of" and "the"

Signed and Sealed this
Tenth Day of December, 2013

Margaret A. Focarino

Margaret A. Focarino
*Commissioner for Patents of the United States Patent and Trademark Office*